US010514195B2

(12) United States Patent
Gu

(10) Patent No.: US 10,514,195 B2
(45) Date of Patent: Dec. 24, 2019

(54) REFRIGERATOR

(71) Applicant: SAMSUNG ELECTRONICS CO., LTD., Suwon-si, Gyeonggi-do (KR)

(72) Inventor: Yang Yeol Gu, Hwasun (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/711,212

(22) Filed: Sep. 21, 2017

(65) Prior Publication Data

US 2018/0010840 A1 Jan. 11, 2018

Related U.S. Application Data

(63) Continuation of application No. 14/794,431, filed on Jul. 8, 2015, now Pat. No. 9,797,646, which is a continuation of application No. 12/929,313, filed on Jan. 13, 2011, now Pat. No. 9,086,234.

(30) Foreign Application Priority Data

Jul. 13, 2010 (KR) ..... 10-2010-0067310

(51) Int. Cl.
*F25D 17/04* (2006.01)
*F25D 17/06* (2006.01)
*F25D 23/06* (2006.01)

(52) U.S. Cl.
CPC ..... *F25D 17/04* (2013.01); *F25D 17/065* (2013.01); *F25D 23/069* (2013.01); *F25D 2317/0672* (2013.01)

(58) Field of Classification Search
CPC ..... F25D 17/04; F25D 17/06; F25D 17/065; F25D 23/069; F25D 2317/0672; F25D 23/06
See application file for complete search history.

(56) References Cited

U.S. PATENT DOCUMENTS

| | | | | |
|---|---|---|---|---|
| 3,321,933 | A | 5/1967 | Scheitlin et al. | |
| 4,632,470 | A | 12/1986 | Jenkins et al. | |
| 4,638,644 | A | 1/1987 | Gidseg | |
| 5,722,252 | A | 3/1998 | Kang et al. | |
| 6,044,654 | A | 4/2000 | Igari et al. | |
| 6,327,867 | B1 * | 12/2001 | Hyodo | F25B 5/04 62/187 |

(Continued)

FOREIGN PATENT DOCUMENTS

| | | |
|---|---|---|
| JP | 4-24481 | 1/1992 |
| JP | 2575519 | 10/1996 |

(Continued)

OTHER PUBLICATIONS

Korean Office Action dated Apr. 30, 2018 in Korean Patent Application No. 10-2018-0032477.

(Continued)

*Primary Examiner* — Melvin Jones
(74) *Attorney, Agent, or Firm* — Staas & Halsey LLP

(57) ABSTRACT

A refrigerator includes a cold air supply device received in an insulating partition that defines a storage compartment into upper and lower storage compartments. As cold air is supplied into the storage compartment below the insulating partition through the cold air supply device, the refrigerator has enhanced productivity and interior volume efficiency.

20 Claims, 7 Drawing Sheets

(56) References Cited

U.S. PATENT DOCUMENTS

| | | | | |
|---|---|---|---|---|
| 6,497,113 | B1 | 12/2002 | Yamada et al. | |
| 7,188,479 | B2 * | 3/2007 | Anselmino | F25C 5/22 62/66 |
| 7,549,300 | B2 | 6/2009 | Chun et al. | |
| 8,336,330 | B2 | 12/2012 | Lee et al. | |
| 2003/0097850 | A1 | 5/2003 | Chang et al. | |
| 2006/0130518 | A1 | 6/2006 | Kang et al. | |
| 2006/0248916 | A1 | 11/2006 | Kim et al. | |
| 2008/0202149 | A1 | 8/2008 | Lim et al. | |
| 2009/0133432 | A1 | 5/2009 | Lee et al. | |
| 2009/0301587 | A1 | 12/2009 | Takagi et al. | |
| 2010/0101263 | A1 | 4/2010 | Lee et al. | |

FOREIGN PATENT DOCUMENTS

| | | |
|---|---|---|
| JP | 11-211311 | 8/1999 |
| JP | 2002-130908 | 5/2002 |
| JP | 2004293804 A | 10/2004 |
| KR | 10-1996-0041985 | 12/1996 |
| KR | 10-2004-0049609 | 6/2004 |

OTHER PUBLICATIONS

Korean Office Action dated Jul. 28, 2017 in Korean Patent Application No. 10-2016-0050685.
Korean Office Action dated Jan. 23, 2017 in Korean Patent Application No. 10-2016-0050685.
Korean Office Action dated Jun. 16, 2016 in Korean Patent Application No. 10-2016-0050685.
Korean Office Action dated Aug. 28, 2015 in corresponding Korean Patent Application No. 10-2010-0067310.
Office Action dated Mar. 15, 2013 in U.S. Appl. No. 12/929,313.
Final Office Action dated Aug. 15, 2013 in U.S. Appl. No. 12/929,313.
Advisory Action dated Dec. 6, 2013 in U.S. Appl. No. 12/929,313.
Office Action dated Feb. 25, 2014 in U.S. Appl. No. 12/929,313.
Final Office Action dated Aug. 29, 2014 in U.S. Appl. No. 12/929,313.
Notice of Allowance dated Mar. 13, 2015 in U.S. Appl. No. 12/929,313.
Office Action dated Aug. 13, 2015 in U.S. Appl. No. 14/794,431.
Office Action dated Oct. 15, 2015 in U.S. Appl. No. 14/794,431.
Office Action dated Feb. 19, 2016 in U.S. Appl. No. 14/794,431.
Advisory Action dated Apr. 22, 2016 in U.S. Appl. No. 14/794,431.
Office Action dated Sep. 21, 2016 in U.S. Appl. No. 14/794,431.
Office Action dated Feb. 17, 2017 in U.S. Appl. No. 14/794,431.
Advisory Action dated Apr. 27, 2017 in U.S. Appl. No. 14/794,431.
Notice of Allowance dated Jun. 21, 2017 in U.S. Appl. No. 14/794,431.
U.S. Appl. No. 14/794,431, filed Jul. 8, 2015, Yang Yeol Gu, Samsung Electronics Co., Ltd.
U.S. Appl. No. 12/929,313 (U.S. Pat. No. 9,086,234), filed Jan. 13, 2011, Yang Yeol Gu, Samsung Electronics Co., Ltd.
Korean Office Action dated Dec. 5, 2017 in Korean Patent Application No. 10-2016-0050685.
Korean Office Action dated Feb. 19, 2018 in Korean Patent Application No. 10-2016-0050685.
Korean Notice of Allowance dated Nov. 19, 2018 in Korean Patent Application No. 10-2018-0032477.

* cited by examiner

REFRIGERATOR

CROSS-REFERENCE TO RELATED APPLICATIONS

This application is a continuation application of U.S. patent application Ser. No. 14/794,431 filed on Jul. 8, 2015, which is a continuation application of U.S. patent application Ser. No. 12/929,313, now U.S. Pat. No. 9,086,234, filed on Jan. 13, 2011, which claims the benefit of Korean Patent Application No. 10-2010-0067310, filed on Jul. 13, 2010 in the Korean Intellectual Property Office, the disclosures of which are incorporated herein by reference.

BACKGROUND

1. Field

Embodiments relate to a cold air supply structure of a refrigerator.

2. Description of the Related Art

Generally, a refrigerator is a device to keep food fresh at a low temperature by supplying low-temperature cold air to a storage compartment in which food is stored. The refrigerator includes a freezing compartment in which food is kept at a freezing temperature or less and a refrigerating compartment in which food is kept at a temperature slightly above freezing.

In recent years, a refrigerator, an upper region of which defines a refrigerating compartment and a lower region of which defines a freezing compartment for convenience, has been developed. In addition, a refrigerator, in which a refrigerating compartment contains an ice-making chamber as well as a plurality of storage spaces, has been developed.

The plurality of storage compartments and the ice-making chamber are subjected to temperature adjustment using cold air generated from an evaporator and thus, a variety of cold air flow structures have been developed to realize effective cooling using the cold air.

When the cold air generated from the evaporator is introduced into the storage compartment, the quantity of cold air has generally been adjusted using a damper or fan according to a preset temperature of the storage compartment.

SUMMARY

Therefore, it is an aspect to provide a refrigerator having a detachable cold air supply device to supply cold air into a storage compartment.

Additional aspects will be set forth in part in the description which follows and, in part, will be apparent from the description, or may be learned by practice of the invention.

In accordance with one aspect, a refrigerator includes a body having a storage compartment, an insulating partition separably coupled to the storage compartment to divide the storage compartment into an upper first storage compartment and a lower second storage compartment, the insulating partition having a cold air discharge hole communicating with the second storage compartment, an opening perforated in a position of a rear wall of the storage compartment for passage of cold air, and a cold air supply device provided in the insulating partition to supply the cold air, having passed through the opening, into the second storage compartment through the cold air discharge hole.

The cold air supply device may include a case having an inlet perforated in one side thereof to communicate with the opening and an outlet perforated in the other side thereof to communicate with the cold air discharge hole, and a path defined in the case to communicate with the inlet and the outlet.

The insulating partition may include a receptacle to receive the case, and the case may be separably coupled to the receptacle.

The receptacle may be indented from a surface of the insulating partition to have an open upper side, and the cold air discharge hole may be provided at a position of the receptacle.

A damper unit may be provided in the case to adjust the flow rate of cold air introduced through the inlet.

A heat wire may be arranged around the inlet.

The refrigerator may further include a cover member to cover the open upper side of the receptacle.

An inner wall of the storage compartment may be provided with a coupling structure for coupling of the insulating partition.

The coupling structure may include a guide groove indented in the inner wall of the storage compartment, and a sealing member may be provided between the guide groove and the insulating partition.

In accordance with another aspect, a refrigerator includes a body having an upper storage compartment and a lower storage compartment divided from each other by a first insulating partition, a second insulating partition separably coupled to the upper storage compartment to divide the upper storage compartment into an upper first storage compartment and a lower second storage compartment, the second insulating partition having a cold air discharge hole perforated in a position thereof, an evaporator provided at the rear side of the lower storage compartment to supply cold air into the lower storage compartment, an opening perforated in a position of a rear wall of the upper storage compartment for passage of cold air generated from the evaporator, and a cold air supply device provided in the second insulating partition and having a path communicating with the opening and the cold air discharge hole to supply the cold air, having passed through the opening, into the second storage compartment.

The cold air supply device may include a damper unit to control the supply of cold air into the path, and the path and the damper unit may be provided in an insulating case.

The second insulating partition may include an indented receptacle to receive the case, and the cold air discharge hole may be provided at a position of the receptacle.

The refrigerator may further include a cover member to cover an open upper side of the receptacle.

The cold air supply device may be separably coupled to the second insulating partition.

A coupling structure for coupling of the second insulating partition may be provided at a position of an inner wall of the upper storage compartment, and the opening may be located at the same height as the coupling structure.

The first storage compartment may include an ice-making chamber defined by an insulating wall, the refrigerator may further include an ice-making chamber return duct, through which the cold air generated from the evaporator is returned after being used to cool the ice-making chamber, and the cold air used to cool the second storage compartment may be returned to the evaporator through the ice-making chamber return duct.

The ice-making chamber return duct may include a cold air return path defined by an insulating wall to allow the cold air, used to cool the second storage compartment, to be returned to the evaporator.

A cold air suction hole communicating with the ice-making chamber return duct may be provided at a position of a rear wall of the second storage compartment, and the refrigerator may further include a protruding anti-inlet cap to cover a part of the cold air suction hole from the upper side thereof.

In accordance with a further aspect, a refrigerator includes a body having an upper storage compartment and a lower storage compartment divided from each other by a horizontal partition, an insulating partition to divide the upper storage compartment into an upper first storage compartment and a lower second storage compartment, the insulating partition having a cold air discharge hole, a first evaporator provided at the rear side of the first storage compartment to cool the first storage compartment, a second evaporator provided at the rear side of the lower storage compartment to cool the lower storage compartment, an opening perforated in a position of a rear wall of the upper storage compartment for passage of cold air generated from the second evaporator, and a cold air supply device received in the insulating partition to supply the cold air, having passed through the opening, into the second storage compartment through the cold air discharge hole.

The insulating partition may be separably provided in the upper storage compartment.

A coupling structure for coupling of the insulating partition may be provided at a position of an inner wall of the upper storage compartment, and the opening may be located at the same height as the coupling structure.

The cold air supply device may be separably coupled to the insulating partition.

The insulating partition may include an indented receptacle to receive the cold air supply device, and a cover member may hermetically cover the receptacle.

The cold air supply device may include an insulating case having an inlet perforated in one side thereof to communicate with the opening and an outlet perforated in the other side thereof with the cold air discharge hole, and a path communicating with the inlet and the outlet may be defined in the insulating case.

The cold air supply device may further include a damper unit to adjust an opening degree of the inlet.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
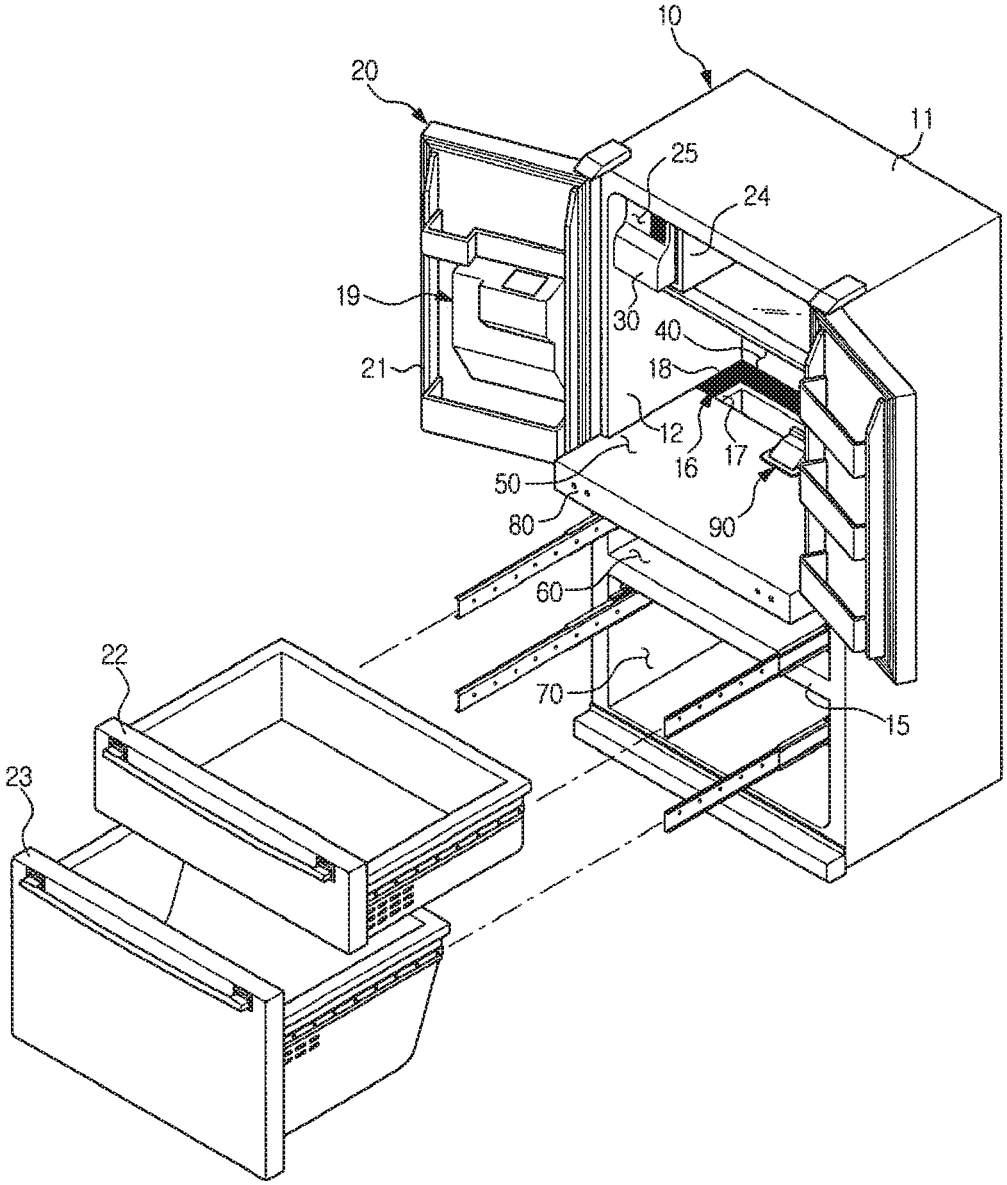
FIG. 1 is a perspective view illustrating a schematic configuration of a refrigerator according to an embodiment.

Reference will now be made in detail to the embodiments, examples of which are illustrated in the accompanying drawings, wherein like reference numerals refer to like elements throughout.

FIG. 1 is a perspective view illustrating a schematic configuration of a refrigerator according to an embodiment.

Referring to FIG. 1, the refrigerator of the present embodiment may include a body 10 in which a plurality of storage compartments is defined, and doors 20 coupled to the body 10 to open or close the plurality of storage compartments respectively.

The body 10 may include an outer shell 11 defining an outer appearance of the body 10, an inner shell 12 installed inside the outer shell 11 to define the plurality of storage compartments, a foam material 13 filled between the outer shell 11 and the inner shell 12, and a machine room 14 (see FIG. 3) in which a plurality of electric parts is received.

The storage compartments may include an upper storage compartment 40 and a lower storage compartment 70 divided from each other by a horizontal partition 15. The upper storage compartment 40 may be divided into upper and lower storage compartments, more particularly, first and second storage compartments 50 and 60 by means of an insulating partition 80 separably coupled to the body 10. Hereinafter, the lower storage compartment 70 is referred to as a third storage compartment.

The inner shell 12 may be provided at a certain position of the upper storage compartment 40 with a coupling structure 16 for coupling of the insulating partition 80.

The coupling structure 16 may include a rail-shaped guide groove 17 indented from an inner wall of the upper storage compartment 40. The insulating partition 80 may be slidably inserted into the guide groove 17 so as to be separably coupled to the upper storage compartment 40.

Although the present embodiment describes the coupling structure 16 in the form of the guide groove 17, the coupling structure 16 has no limit in shape so long as it enables coupling of the insulating partition 80. For example, the coupling structure 16 may take the form of a guide protrusion, and the insulating partition 80 may have a guide groove for insertion of the guide protrusion.

A sealing member 18 may be provided between the guide groove 17 and the insulating partition 80 to provide a hermetic seal and thermal insulation between the first storage compartment 50 and the second storage compartment 60 that are separated from each other by the insulating partition 80.

With the above described configuration, the first storage compartment 50, second storage compartment 60 and third storage compartment 70 may define independent storage spaces respectively, such that storage temperatures of the storage compartments may be independently controlled according to the quantity of cold air supplied into the respective storage compartments.

Although the present embodiment describes the first storage compartment 50 as serving as a refrigerating compartment, the second storage compartment 60 as serving as a special fresh compartment, and the third storage compartment as serving as a freezing compartment, the roles of the respective storage compartments may be changed as necessary.

The doors 20 may include a rotatable door 21 rotatably coupled to the body 10 to open or close the first storage compartment 50, and drawer-type doors 22 and 23 slidably coupled to the body 10 to open or close the second and third storage compartments 60 and 70 respectively.

The rotatable door 21 may be provided with a dispenser 19 to allow a user to retrieve beverages or ice from the outside of the body 10.

The first storage compartment 50 may contain an ice-making chamber 25 defined in a partial upper region thereof by an insulating wall 24. An ice-making device 30 may be received in the ice-making chamber 25.

Figure 3:
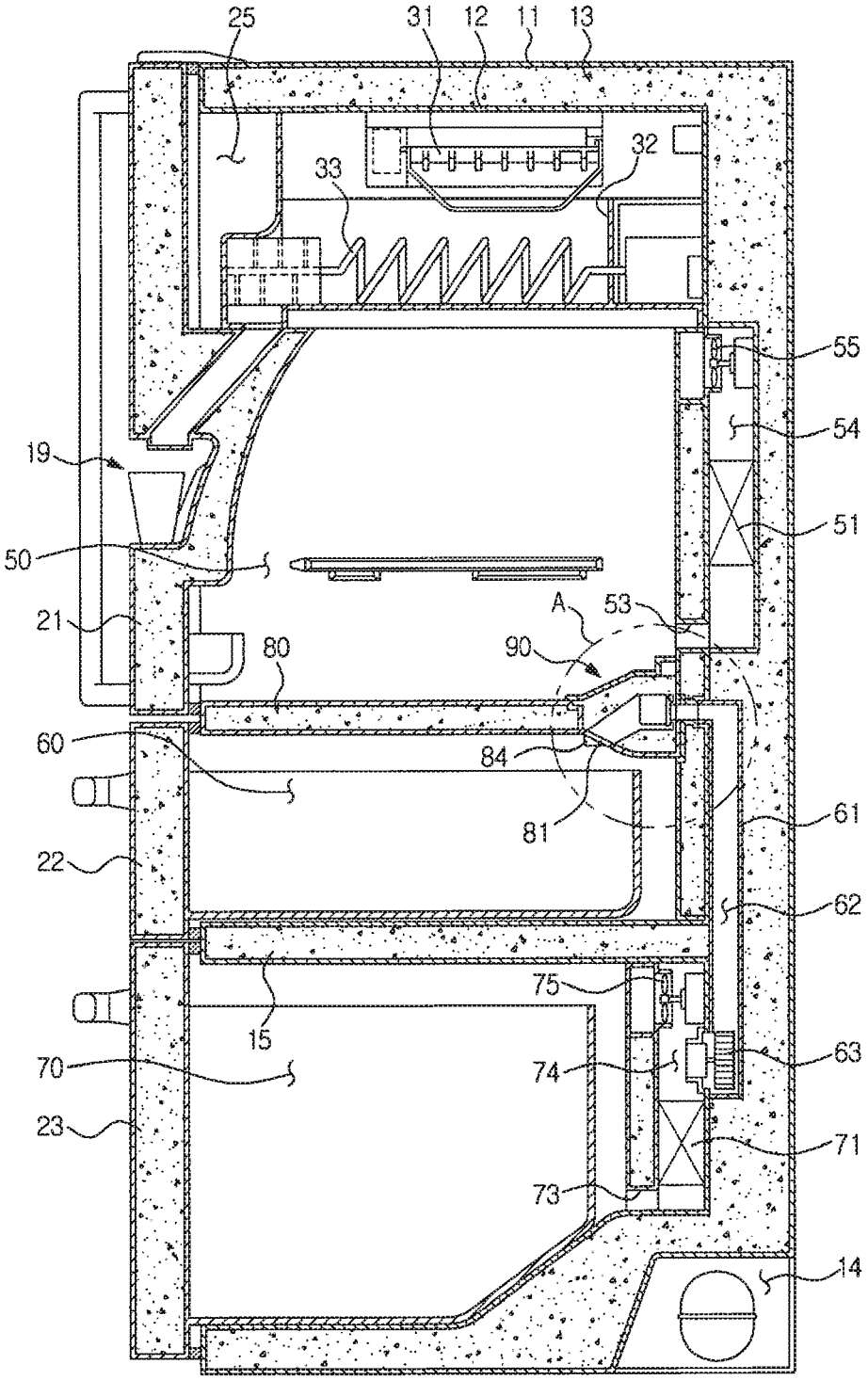
FIG. 3 is a schematic sectional view of the refrigerator according to the embodiment.

The ice-making device 30, as illustrated in FIG. 3, may include an icemaker 31 to make ice, an ice container 32 in which the ice made by the icemaker 31 is stored, and a transfer unit 33 to transfer the ice stored in the ice container 32 to the dispenser 19.

Hereinafter, a cold air flow structure of the refrigerator according to the embodiment will be described.

Figure 2:
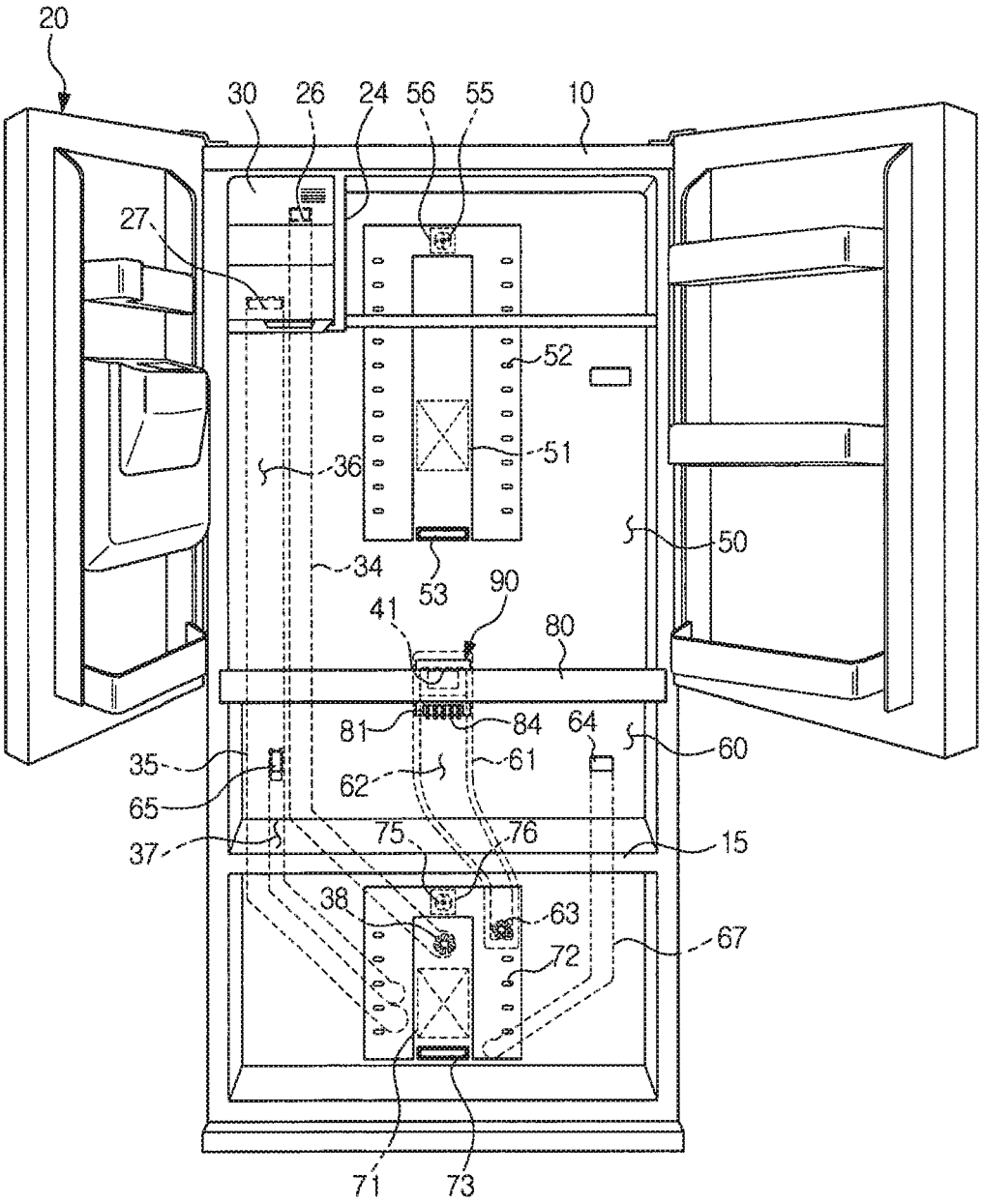
FIG. 2 is a view illustrating a cold air flow structure of the refrigerator according to the embodiment.

FIG. 2 is a view illustrating the cold air flow structure of the refrigerator according to the embodiment, and FIG. 3 is a schematic sectional view of the refrigerator according to the embodiment.

Referring to FIGS. 2 and 3, a first evaporator 51 for cooling of the first storage compartment 50 may be mounted at the rear side of the first storage compartment 50, and a second evaporator 71 for cooling of the third storage compartment 70 may be mounted at the rear side of the third storage compartment 70.

Cold air generated from the first evaporator 51 may be introduced into the first storage compartment 50 through a plurality of first discharge holes 52 perforated in a rear wall of the first storage compartment 50. After being used to cool the first storage compartment 50, the air may be returned into the first evaporator 51 through a first suction hole 53 perforated in a lower position of the rear wall of the first storage compartment 50.

To this end, as illustrated in FIG. 3, a first cold air path 54 may be defined at the rear side of the first storage compartment 50 to communicate with the first discharge holes 52 and the first suction hole 53.

A first circulating fan 55 may be located in an upper region of the first cold air path 54, for circulation of the cold air of the first storage compartment 50.

Specifically, to circulate the cold air of the first storage compartment 50, the first circulating fan 55 suctions the air, used to cool the first storage compartment 50, through the first suction hole 53, and then, supplies the air, cooled while passing through the first evaporator 51, into the first storage compartment 50 through the plurality of first discharge holes 52.

In this case, the quantity of cold air supplied into the first storage compartment 50 may be adjusted using a first cold air adjusting device 56 (see FIG. 2) provided at the rear side of the first storage compartment 50.

Cold air generated from the second evaporator 71 may be introduced into the third storage compartment 70 through a plurality of second discharge holes 72 perforated in a rear wall of the third storage compartment 70. After being used to cool the third storage compartment 70, the air may be returned into the third evaporator 71 through a second suction hole 73 perforated in a lower position of the rear wall of the third storage compartment 70.

To this end, as illustrated in FIG. 3, a second cold air path 74 may be defined at the rear side of the third storage compartment 70 to communicate with the second discharge holes 72 and the second suction hole 73.

A second circulating fan 75 may be located in an upper region of the second cold air path 74, for circulation of the cold air of the third storage compartment 70.

Specifically, to circulate the cold air of the third storage compartment 70, the second circulating fan 75 suctions the air, used to cool the third storage compartment 70, through the second suction hole 73, and then, supplies the air, cooled while passing through the second evaporator 71, into the third storage compartment 70 through the plurality of second discharge holes 72.

In this case, the quantity of cold air supplied into the third storage compartment 70 may be adjusted using a second cold air adjusting device 76 (see FIG. 2) provided at the rear side of the third storage compartment 70.

In the meantime, a part of the cold air generated from the second evaporator 71 may be supplied into the ice-making chamber 25 and the second storage compartment 60.

To circulate cold air of the ice-making chamber 25, an ice-making chamber supply duct 34 and an ice-making chamber return duct 35 may be provided in a rear region of the body 10 between the inner shell 12 and the outer shell 11, to communicate with the second evaporator 71 and the ice-making chamber 25.

The ice-making chamber supply duct 34 may communicate, at one end thereof, with a third discharge hole 26 of the ice-making chamber 25 and, at the other end thereof, with a space around the second evaporator 71, to define a path through which the cold air generated from the second evaporator 71 is supplied into the ice-making chamber 25.

The ice-making chamber return duct 35 may communicate, at one end thereof, with a third suction hole 27 of the ice-making chamber 25 and, at the other end thereof with the space around the second evaporator 71, to define a cold air return path 36 through which the air used to cool the ice-making chamber 25 is returned to the second evaporator 71.

In this case, the circulation of cold air may be realized by a third circulating fan 38 arranged above the second evaporator 71.

A cold air supply duct 61 may be provided in a rear region of the body 10 between the inner shell 12 and the outer shell 11, to communicate with the second evaporator 71 and the second storage compartment 60 for circulation of cold air of the second storage compartment 60.

A fourth circulating fan 63 may be arranged at a position close to the second evaporator 71 to supply cold air into the cold air supply duct 61.

Once the cold air generated from the second evaporator 71 is supplied into a third cold air path 62 of the cold air supply duct 61, the cold air may be supplied into the second storage compartment 60 through a cold air supply device 90 mounted in a rear region of the insulating partition 80.

To this end, the insulating partition 80 has a cold air discharge hole 81 perforated in a rear lower portion thereof to introduce the cold air, supplied by the cold air supply device 90, into the second storage compartment 60. The cold air discharge hole 81 may protrude from a lower surface of the insulating partition 80 and may communicate with the cold air supply device 90.

Figure 4:
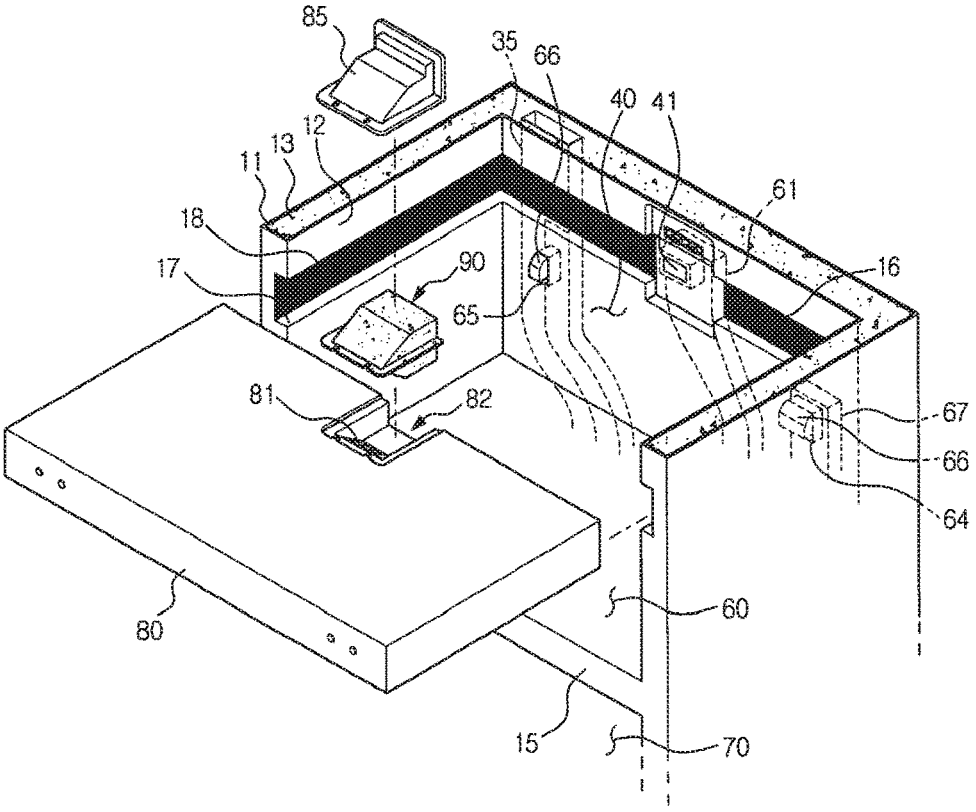
FIG. 4 is a partial exploded perspective view of a cold air supply device to supply cold air into a second storage compartment of the refrigerator according to the embodiment.

FIG. 4 is a partial exploded perspective view of the cold air supply device to supply cold air into the second storage compartment of the refrigerator according to the embodiment.

Referring to FIG. 4, an opening 41 may be perforated in a lower position of a rear wall of the upper storage compartment 40 to communicate with the cold air supply duct 61 through which the cold air generated from the second evaporator 71 is supplied into the second storage compartment 60.

The opening 41 may serve to supply the cold air, generated from the second evaporator 71, into the second storage compartment 60 and may communicate with the cold air supply device 90 mounted in the insulating partition 80 that is separably coupled to the upper storage compartment 40.

The opening 41 may be located at the same position as the guide groove 17 for insertion of the insulating partition 80. This serves to improve space utilization of the storage compartment.

In the case where the insulating partition 80 is mounted in the guide groove 17 of the upper storage compartment 40 to divide the upper storage compartment 40 into the upper first storage compartment 50 and the lower second storage compartment 60, a portion of the insulating partition 80 facing the opening 41 may define a receptacle in which the cold air supply device 90 is seated and fixed.

The receptacle 82 may be indented from an upper surface of the insulating partition 80 to have an open upper side and an open rear side facing the opening 41. The receptacle 82 may be integrally formed with the insulating partition 80, or may be separately formed and then, be coupled to the insulating partition 80.

The cold air discharge hole 81 may be perforated in the bottom of the receptacle 82 to communicate with the second storage compartment 60.

The cold air discharge hole 81 serves to introduce cold air into the second storage compartment 60 below the insulating partition 80, and may be perforated in a position of the bottom of the receptacle 82.

The cold air discharge hole 81 may be provided with a blade 84 (see FIG. 2) to guide the flow of cold air introduced into the second storage compartment 60.

The cold air supply device 90 may be separably coupled into the receptacle 82 and may serve to adjust the supply of cold air into the second storage compartment 60 in the course of transferring the cold air from the opening 41 to the cold air discharge hole 81.

The cold air supply device 90 has an outer contour corresponding to the contour of the receptacle 82. Once the cold air supply device 90 is seated and fixed in the receptacle 82, an upper surface of the cold air supply device 90 may define the same plane as, or may protrude from the upper surface of the insulating partition 80.

A cover member 85 may be provided to hermetically cover the open upper side of the receptacle 82 after the cold air supply device 90 is seated in the receptacle 82.

With the above described configuration, the cold air supply device 90 used to supply cold air into the second storage compartment 60 may be easily installed even after the insulating partition 80 is mounted in the storage compartment, and also, may assure effective supply of cold air into the second storage compartment 60 with a simplified configuration.

Further, the cold air supply device 90 may assure easy repair or exchange thereof by enabling the user to easily access the same from the front side of the storage compartment, thus providing enhanced installation convenience thereof.

Furthermore, in the case where the cold air supply device 90 is mounted in the insulating partition 80, it may be possible to reduce a space for installation of a motor or fan, resulting in enhanced interior space utilization of the refrigerator. In this case, it may be unnecessary to secure an installation height of a duct even if the storage compartment has a low height, and this may be advantageous to further overcome a limit in an installation space.

Although the present embodiment describes the insulating partition 80 as being separably coupled to the upper storage compartment 40, the insulating partition 80 may be integrally formed with the body 10. Even in this case, of course, the receptacle 82 may be integrally formed with the insulating partition 80.

The receptacle 82 has no limit in shape so long as it allows the cold air supply device 90 to be received in the insulating partition 80. For example, the receptacle 82 may have a drawer shape such that the cold air supply device 90 may be slidably put into or pulled out of the receptacle 82. In this case, of course, the insulating partition 80 may be separably provided.

Hereinafter, the cold air supply device according to the embodiment of the present invention will be described in more detail.

Figure 5:
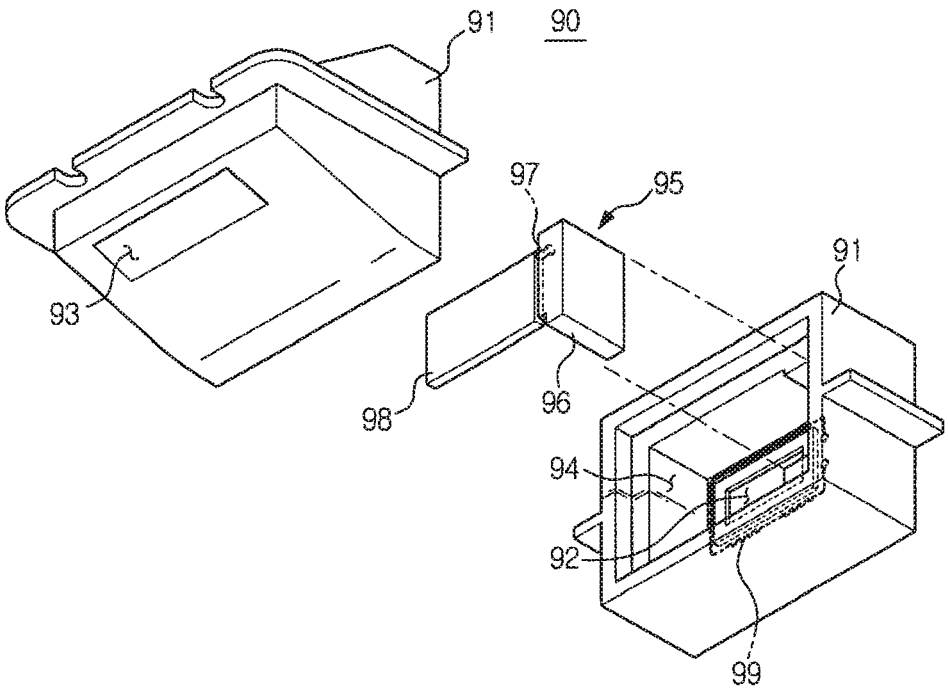
FIG. 5 is a view illustrating the cold air supply device according to the embodiment.
Figure 6:
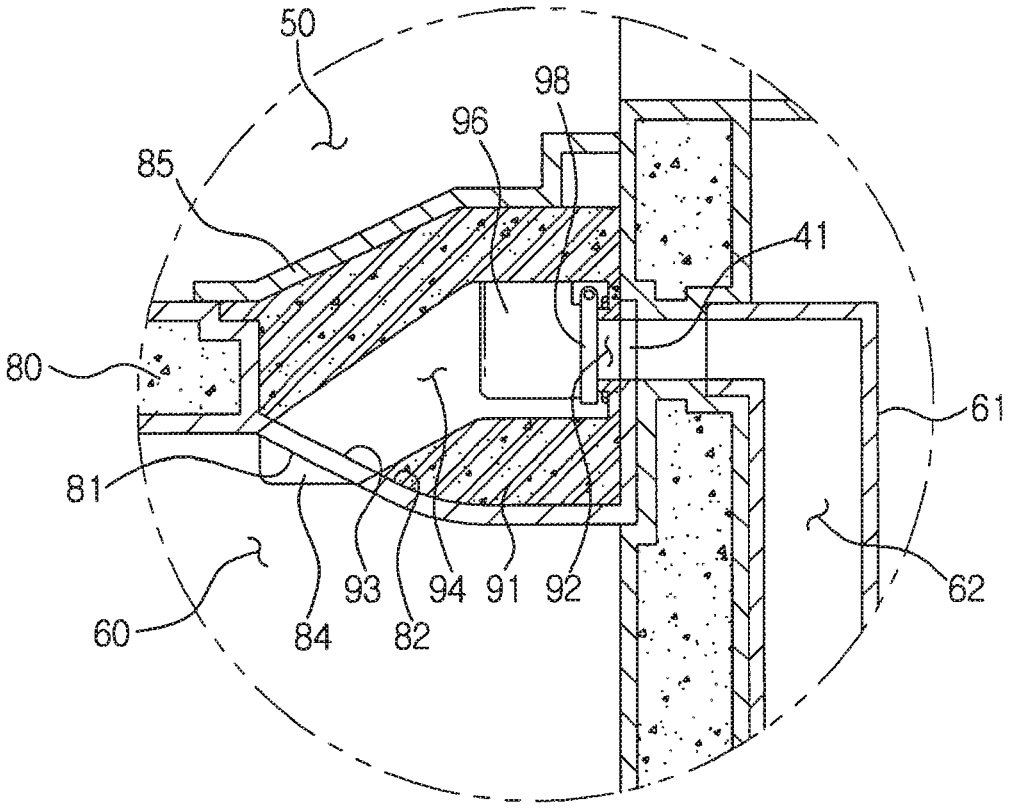
FIG. 6 is an enlarged view of a portion 'A' of FIG. 3.
Figure 7:
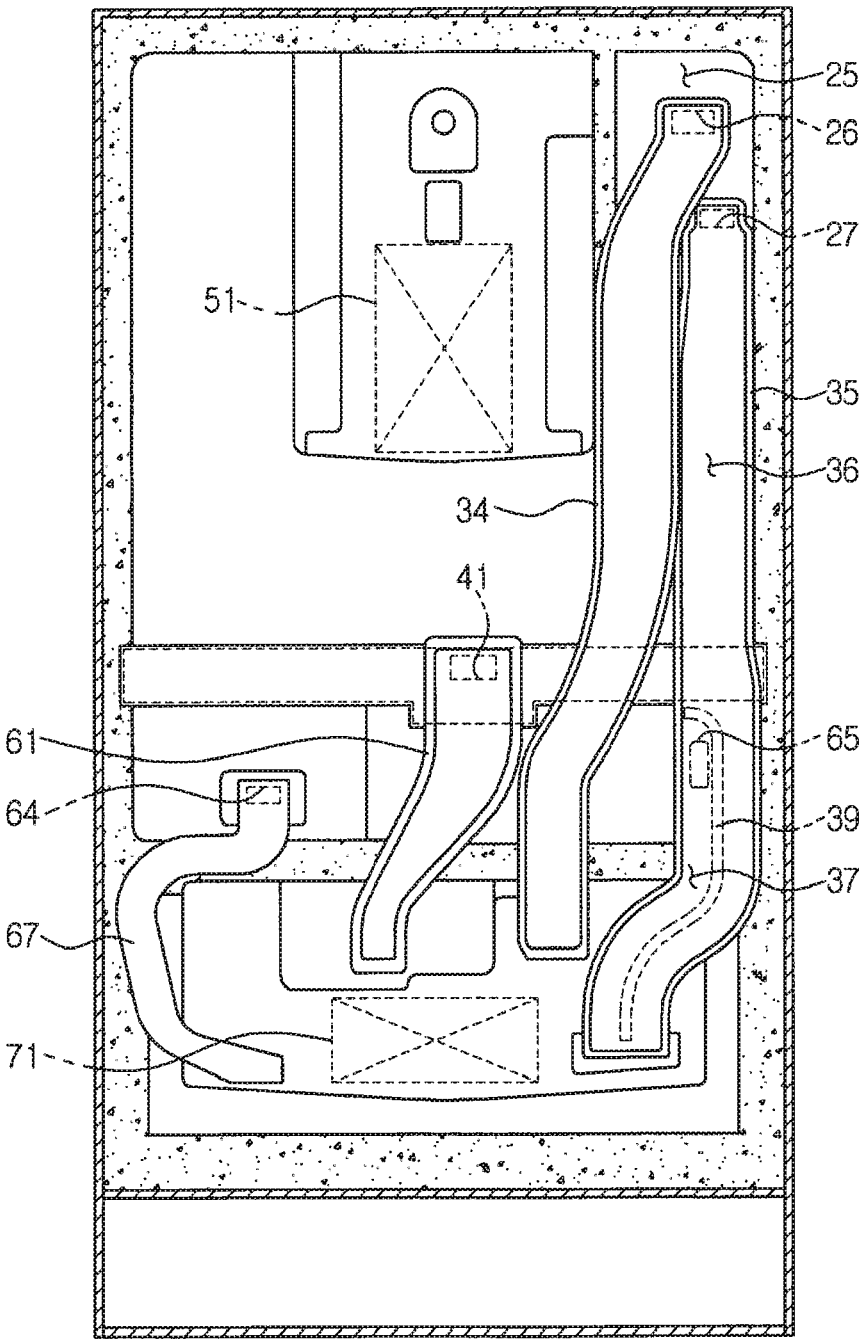
FIG. 7 is a view illustrating a duct structure provided at a rear surface of the refrigerator according to the embodiment.

FIG. 5 is a view illustrating the cold air supply device according to the embodiment, FIG. 6 is an enlarged view of a portion 'A' of FIG. 3, and FIG. 7 is a view illustrating a duct structure provided at a rear surface of the refrigerator according to the embodiment.

Referring to FIGS. 5 and 6, the cold air supply device 90 may include a case 91 defining an outer appearance of the cold air supply device 90, a path 94 defined in the case 91 for the flow of cold air, and a damper unit 95 to adjust the flow rate of cold air in the path 94.

The case 91 may be made of an insulating material to prevent loss of cold air, such as Styrofoam, and may have a shape corresponding to that of the receptacle 82 defined in the insulating partition 80 so as to be seated in the receptacle 82.

The case 91 is provided at one side thereof with an inlet 92 through which cold air is introduced into the path 94, and at the other side thereof facing the cold air discharge hole 81 with an outlet 83 through which the cold air is discharged from the path 94.

Once the case 91 is seated in the receptacle 82, the inlet 92 communicates with the opening 41 perforated in the rear wall of the upper storage compartment 40, and the outlet 93 communicates with the cold air discharge hole 81 perforated in the bottom of the receptacle 82.

Specifically, the path 94 for the flow of cold air is defined between the inlet 92 and the outlet 93 to communicate with the second evaporator 71 and the second storage compartment 60 through the inlet 92 and the outlet 93.

Although the present embodiment describes the cold air discharge hole 81 as being perforated in the bottom of the receptacle 82, the outlet 93 of the cold air supply device 90 may function as the cold air discharge hole 81.

The damper unit 95 may be provided in the case 91 to adjust the flow rate of cold air in the path 94. Specifically, the damper unit 95 serves to adjust the flow rate of cold air moved from the second evaporator 71 into the path 94 through the opening 41 according to an opening degree of the inlet 92. The damper unit 95 may include a drive 96 and a rotating plate 98 driven by the drive 96 to open or close the inlet 92.

The rotating plate 98 may have a rectangular shape corresponding to the shape of the inlet 92, and may be coupled to a rotating shaft 97 of the drive 96 so as to be rotated to an opening position according to a storage temperature of the second storage compartment 60.

The drive 96 may be selected from various ones that provide power required to rotate the rotating plate 98, and conventionally, may include, e.g., a motor or gears that transmit rotating power of the motor.

A heat wire 99 may be provided around the inlet 92 that is opened or closed by the damper unit 95 and may serve to prevent frosting or dew condensation due to a temperature difference of cold air.

Although the present embodiment describes the damper unit 95 provided in the case 91 of the cold air supply device 90 to adjust the flow rate of cold air by way of example, the flow rate of cold air may be adjusted using a pan instead of the damper unit 95.

In one alternative embodiment, the cold air supply device 90 may contain only the path 94 inside the case 91 without the damper unit 95 or the pan. In this case, the damper unit 95 or the pan may be provided at the rear side of the storage compartment. In another alternative embodiment, both the damper unit 95 and the pan may be provided in the case 91.

With the above described configuration, the cold air generated from the second evaporator 71 is supplied into the cold air supply duct 61 via operation of the fourth circulating fan 63 (see FIG. 3) and thereafter, is introduced into the case 91 through the inlet 92 communicating with the opening 41.

In this case, the damper unit 95 may adjust the flow rate of cold air introduced into the path 94 by adjusting the opening degree of the inlet 92. The cold air introduced into the path 94 is discharged into the second storage compartment 60 through the cold air discharge hole 81 communicating with the outlet 93, thereby serving to cool the second storage compartment 60.

Then, the air used to cool the second storage compartment 60 is returned to the second evaporator 71. To this end, as illustrated in FIG. 4, cold air suction holes 64 and 65 for suction of the cold air of the second storage compartment 60 may be formed at opposite lateral positions of a rear wall of the second storage compartment 60 below the insulating partition 80.

Anti-inlet caps 66 may be provided above the cold air suction holes 64 and 65 to cover a part of the respective cold air suction holes 64 and 65.

The anti-inlet caps 66 serve to prevent the cold air, introduced into the second storage compartment 60 through the cold air discharge hole 81, from directly entering the cold air suction holes 64 and 65 rather than being used to cool the second storage compartment 60, thereby enhancing cooling efficiency of the second storage compartment 60.

Specifically, the anti-inlet caps 66 cover the upper side of the cold air suction holes 64 and 65 such that cold air having a relatively high temperature below the cold air suction holes 64 and 65 is suctioned into the cold air suction holes 64 and 65.

Once the air used to cool the second storage compartment 60 is suctioned through the cold air suction holes 64 and 65, the suctioned air is returned to the second evaporator 71.

To this end, as illustrated in FIG. 7, a cold air return duct 67 may be provided at a position of a rear surface of the inner shell 12 to communicate at one end thereof with the cold air suction hole 64 and at the other end thereof with the second evaporator 71.

The cold air suction hole 65 may be arranged close to the ice-making chamber return duct 35 through which the cold air used to cool the ice-making chamber 25 is returned, to allow the cold air of the second storage compartment 60 to be returned to the second evaporator 71 through the ice-making chamber return duct 35. This serves not only to enhance space utilization owing to a reduced duct installation space, but also to increase installation convenience.

To this end, a cold air return path 37 may be provided in the ice-making chamber return duct 35 to communicate at one end thereof with the cold air suction hole 65 and at the other end thereof with the second evaporator 71.

The cold air return path 37 may be separated from the ice-making chamber return path 36, through which the cold air used to cool the ice-making chamber 25 is returned, by means of an insulating wall 39.

The insulating wall 39 may serve to prevent frosting or dew condensation due to a temperature difference between the cold air of the ice-making chamber return path 36 moved from the ice-making chamber 25 and the cold air of the cold air return path 37 moved from the second storage compartment 60.

As is apparent from the above description, a refrigerator according to an embodiment of the present invention may achieve enhanced interior volume efficiency.

Further, the refrigerator may achieve enhanced manufacturing efficiency and productivity owing to a simplified cold air flow structure thereof.

Although a few embodiments have been shown and described, it would be appreciated by those skilled in the art that changes may be made in these embodiments without departing from the principles and spirit of the invention, the scope of which is defined in the claims and their equivalents.

The invention claimed is:

1. A refrigerator comprising:

a body formed with an inner wall and an outer wall;

a first compartment formed in an upper portion of the body;

a second compartment formed in a lower portion of the body;

a third compartment formed in a middle portion of the body;

a first heat exchanger provided to supply cold air into the first compartment;

a second heat exchanger provided to supply cold air into the second compartment;

a cold air supply device to supply cold air towards a front side of the third compartment;

a lower partition wall to separate the third compartment and the second compartment within the body; and an upper partition wall to separate the third compartment and the first compartment within the body;

wherein at least one of the lower partition wall and the upper partition wall is provided with insulation inside the at least one of the lower partition wall and the upper partition wall, and a guide groove is formed as an indentation in the inner wall of the body located on a rear surface of the inner wall and located on at least one of opposite side surfaces of the inner wall corresponding to a position of coupling the at least one of the lower partition wall and the upper partition wall to the inner wall of the body.

2. The refrigerator according to claim 1, wherein the upper partition wall includes a receptacle provided in a horizontal surface of the upper partition wall, the horizontal surface forming an interior space of the third compartment usable for storing food, at least a portion of the cold air supply device is separably mounted in the receptacle, and at least a portion of the cold air supply device protrudes from the horizontal surface of the upper partition wall into the interior space of the third compartment.

3. The refrigerator according to claim 1, wherein a sealing member is provided in the guide groove to provide a hermetic seal and thermal insulation between the at least one of the opposite side surfaces of the inner wall and the rear surface of the inner wall and the at least one of the lower partition wall and the upper partition wall.

4. The refrigerator according to claim 1, wherein the guide groove located in the rear surface of the inner wall includes an opening to provide cold air from the at least one of the first heating exchanger and the second heating exchanger.

5. The refrigerator according to claim 1, further comprising a sealing member configured to provide a hermetic seal between the inner wall and the at least one of the lower partition wall and the upper partition wall.

6. The refrigerator of claim 1, wherein the cold air supply device further comprises a blade to guide a flow of the cold air towards the front side of the third compartment.

7. The refrigerator of claim 1, wherein the cold air supply device includes an outlet positioned below a lower surface of the upper partition wall to discharge the cold air.

8. A refrigerator comprising:

a body formed with an inner wall and an outer wall;

a first compartment formed in an upper portion of the body;

a second compartment formed in a lower portion of the body;

a third compartment formed in a middle portion of the body;

a first heat exchanger provided to supply cold air into the first compartment;

a second heat exchanger provided to supply cold air into the second compartment;

a cold air supply device to supply cold air towards a front side of the third compartment; and an upper partition wall to separate the third compartment and the first compartment within the body;

wherein the upper partition wall includes a receptacle provided in a horizontal surface of the upper partition wall, the horizontal surface forming an interior space of the third compartment usable for storing food, at least a portion of the cold air supply device is separably mounted in the receptacle, and at least a portion of the cold air supply device protrudes from the horizontal surface of the upper partition wall into the interior space of the third compartment, and a guide groove is formed with the inner wall of the body on a location of a rear surface of the inner wall and on a location of at least one of opposite side surfaces of the inner wall corresponding to a position of coupling the upper partition wall to the inner wall of the body.

9. The refrigerator according to claim 8, further comprising a sealing member configured to provide a seal between the inner wall and the upper partition wall.

10. The refrigerator according to claim 8, wherein the guide groove includes an opening to provide cold air from the at least one of the first heat exchanger and the second heat exchanger to the cold air supply device.

11. The refrigerator of claim 8, wherein the cold air supply device further comprises a blade to guide a flow of the cold air towards the front side of the third compartment.

12. The refrigerator of claim 8, wherein the cold air supply device includes an outlet positioned below a lower surface of the upper partition wall to discharge the cold air.

13. A refrigerator comprising:

a body formed with an inner wall and an outer wall;

a partition wall configured to partition the body into a first compartment and a second compartment, the partition wall including a receptacle provided in a horizontal surface of the partition wall;

a cold air discharging unit to supply cold air towards a front side of the second compartment, at least a portion of the cold air discharging unit being separably mounted in the receptacle, and at least a portion of the cold air discharging unit protrudes from the horizontal surface of the upper partition wall; and a guide groove is formed as an indentation in the inner wall of the body located on a rear surface of the inner wall and located on at least one of opposite side surfaces of the inner wall corresponding to a position of coupling the partition wall to the inner wall of the body.

14. The refrigerator of claim 13, further comprising a sealing member configured to provide a seal between the inner wall and the partition wall.

15. The refrigerator of claim 13, wherein the partition wall is further configured to receive insulation.

16. The refrigerator of claim 13, wherein the partition wall is provided with insulation inside the partition wall.

17. The refrigerator of claim 13, further comprising another partition wall configured to partition one of the first compartment and the second compartment into two compartments.

18. The refrigerator of claim 13, further comprising a heat exchanger to supply cold air into at least one of the first compartment and the second compartment.

19. The refrigerator of claim 13, wherein the cold air discharging unit further comprises a blade to guide a flow of the cold air towards the front side of the second compartment.

20. The refrigerator of claim 13, wherein the cold air discharging unit includes an outlet positioned below a lower surface of the partition wall to discharge the cold air.

* * * * *